US005178110A

United States Patent [19]

Guggenbichler et al.

[11] Patent Number: 5,178,110

[45] Date of Patent: Jan. 12, 1993

[54] FUEL INJECTION DEVICE FOR INTERNAL COMBUSTION ENGINES

[75] Inventors: Franz Guggenbichler; Jaroslaw Hlousek, both of Golling, Austria

[73] Assignee: Robert Bosch GmbH, Stuttgart, Fed. Rep. of Germany

[21] Appl. No.: 752,434

[22] PCT Filed: Dec. 22, 1990

[86] PCT No.: PCT/DE90/00991

§ 371 Date: Aug. 19, 1991

§ 102(e) Date: Aug. 19, 1991

[87] PCT Pub. No.: WO91/10059

PCT Pub. Date: Jul. 11, 1991

[30] Foreign Application Priority Data

Jan. 3, 1990 [DE] Fed. Rep. of Germany ..... 4000043
Sep. 14, 1990 [DE] Fed. Rep. of Germany ..... 4029159

[51] Int. Cl.[5] ..... F02M 45/06
[52] U.S. Cl. ..... 123/300; 417/494
[58] Field of Search ..... 239/88, 89, 90, 91; 123/299, 300; 417/494, 499

[56] References Cited

U.S. PATENT DOCUMENTS 4,426,198 1/1984 Bastenhof et al. ..... 123/299
5,074,766 12/1991 Kochanowski ..... 123/299

FOREIGN PATENT DOCUMENTS 0210957 2/1987 European Pat. Off. .
1198610 8/1965 Fed. Rep. of Germany .
1253952 11/1967 Fed. Rep. of Germany .
2131195 12/1971 Fed. Rep. of Germany ..... 123/299
105867 5/1974 Fed. Rep. of Germany .
1313624 11/1962 France .
1348807 12/1963 France .
2028421 3/1980 United Kingdom .
2114236 8/1983 United Kingdom .

*Primary Examiner*—Andres Kashnikow
*Assistant Examiner*—Karen B. Merritt
*Attorney, Agent, or Firm*—Edwin E. Greigg; Ronald E. Greigg

[57] ABSTRACT

A fuel injection device for injection internal combustion engines comprising a main injection plunger and a preinjection plunger, which is arranged coaxially with the latter and separated from the latter, and has a smaller diameter. The preinjection plunger is driven non-positively by the main injection plunger to make stroke movements against the force of at least one spring, which holds the preinjection plunger to bear against the main injection plunger. During the main injection, the working chamber of the preinjection plunger is connected to the working chamber of the main injection plunger, so that the preinjection plunger adds an injection portion to the main injection amount after termination of the preinjection and the spray interval, and the fuel pressure occurring in the working chamber of the preinjection plunger supports the action of the spring.

24 Claims, 10 Drawing Sheets

FUEL INJECTION DEVICE FOR INTERNAL COMBUSTION ENGINES

The invention relates to a fuel device for injection internal combustion engines, comprising a main plunger and a preinjection plunger, which is arranged coaxially with the latter and driven by the latter to make axial stroke movements, and has a smaller diameter, the main injection plunger being rotatable and fitted with a bevelled-edge control, and the preinjection plunger being held in contact with the main injection plunger by the force of one or more springs, and separate injection nozzles being provided for the main injection and preinjection. Known fuel injection devices of this type in which, however, the preinjection plunger is axially non-displaceably connected to the main injection plunger have become known, for example, from German Patent 577,288, Austrian Patent 227,479, German Patent 1,187,857 and German Patent 1,028,387.

In accordance with an unpublished proposal, it has already been suggested to construct the preinjection plunger separately and support it against the main injection plunger, the aim being for the preinjection plunger to be driven by the main injection plunger to make the compression stroke, and to be held by a spring, acting against the compression stroke of the preinjection plunger, so as to bear against the main injection plunger. The pressure in the working chamber of the main injection plunger now acts on the end face of the preinjection plunger facing the main injection plunger, and the preinjection plunger is to be pressed on the main injection plunger against this force by the spring. The force of the spring must therefore overcome the force exerted on the preinjection plunger by this pressure, with the result that the spring would have to be constructed greatly oversized. In modern injection pumps, the injection pressure in the working chamber of the main injection plunger is very high, and is up to 1200 bar, or even more. However, a spring which can over-come this force would have dimensions that make accommodating the spring in the pump impossible. This proposal therefore cannot be realised, particularly in the case of high injection pressures. Regardless of this, in the known designs only the annular surface between the outer circumference of the main injection plunger and the circumference of the preinjection plunger is available for the main injection. In order to achieve a sufficient main injection amount, it is therefore necessary for the main injection plunger to be constructed with a relatively large diameter, as a result of which the structural dimensions of the injection pump are enlarged.

The object of the invention is to improve, and reduce the structural dimensions of, an injection pump in which a preinjection plunger separated from the main injection plunger is held bearing against the main injection plunger by means of a spring force.

In order to achieve this object, the essence of the invention is that the preinjection plunger delivers a portion of the main injection amount after termination of the preinjection and the spray interval. Since, during the main injection, i.e. during the period in which the high injection pressure acts in the working chamber of the main injection plunger, the preinjection plunger also delivers fuel at the pressure occurring during the main injection in the working chamber of the main injection plunger, during this period the working chamber of the preinjection plunger is also at a pressure corresponding to the main injection pressure, and the preinjection plunger is loaded by the main injection pressure in the direction of the spring force acting on it. There is thus no need for the spring to overcome the pressure occurring in the working chamber of the main injection plunger, and a very weak design of this spring therefore suffices, so that this spring can easily be accommodated. Because the preinjection plunger now delivers a portion of the main injection amount during the main injection, the diameter of the main injection plunger can be constructed to be smaller, so that the structural dimensions of the injection pump are reduced.

The advantage of a preinjection plunger that is separated from the main injection plunger and is held bearing against the main injection plunger by means of spring force consists in that in the event of frictional rubbing or jamming of the preinjection plunger, this preinjection plunger can still be brought, against the action of the spring force, into its highest position by the main injection plunger, in which position it then comes to a standstill and does not obstruct the stroke movement of the main injection plunger. It is thus possible for the injection pump to be operated under emergency conditions until the next overhaul using only the main injection, only the preinjection being lost. The utilisation of this advantage is permitted by the invention.

In accordance with the invention, the delivery rate of the preinjection plunger can be utilised for the main injection amount in a simple way when the working chamber of the preinjection plunger can be connected after termination of the preinjection to the working chamber of the main injection plunger or to a delivery bore leading from this working chamber to the main injection nozzle. During the main injection, the amount of fuel delivered by the preinjection plunger is thus added to the amount of fuel delivered by the main injection plunger, and the pressures are equal at both ends of the preinjection plunger. Upon termination of the preinjection, the working chamber of the preinjection plunger can be unloaded by connection to the suction chamber, so that a very rapid pressure drop takes place in the delivery line leading to the preinjection nozzle. It is also possible, however, for the working chamber of the preinjection plunger to be connected to the working chamber of the main injection plunger, since the latter is still unloaded at this instant.

In accordance with a preferred embodiment of the invention, the connection of the working chamber of the preinjection plunger to the working chamber of the main injection plunger is controlled by the preinjection plunger. In accordance with the invention, this can take place when the preinjection plunger has a central bore, which is open towards the working chamber of the preinjection plunger and discharges via a transverse bore into an annular chamber, which is delimited by a control edge and a shoulder and which can be connected via a bore to the delivery bore leading to the main injection nozzle.

In accordance with the invention, the preinjection plunger can be equipped with straight control edges for controlling the start and the end of the preinjection, and can be freely rotatable with respect to the main injection plunger, since the rotary position of the preinjection plunger is immaterial.

In accordance with an advantageous embodiment of the invention, however, the preinjection plunger can be equipped with control edges for controlling the start and the end of the preinjection, of which at least one extends obliquely, the preinjection plunger being rotatable by means of a separate control rod. In this case, the preinjection plunger is also freely rotatable with respect to the main injection plunger, and can be adjusted in its rotary position independently of the main injection plunger.

However, the arrangement can also be set up such that the preinjection plunger is equipped with control edges for controlling the start and the end of the preinjection, of which at least one extends obliquely, and that the preinjection plunger is coupled for rotation by means of a torque-limiting coupling to the main injection plunger. In this case a separate control rod for the preinjection plunger is eliminated. Since the preinjection plunger is coupled for rotation by means of a torque-limiting coupling to the main injection plunger, in the event of seizing or jamming of the preinjection plunger it is possible, in this case as well, for operation under emergency conditions to be carried out by means of the main injection plunger alone, since seizing or jamming of the preinjection plunger does not block the rotary movement of the main injection plunger. Such a coupling of the preinjection plunger to the main injection plunger can take place in accordance with the invention by means of a driver, which is guided axially displaceably and non-rotatably on the main injection plunger and against which is supported the spring holding the preinjection plunger bearing against the main injection plunger. In this way, in the event of seizing of the preinjection plunger the main injection plunger remains axially freely movable, and is also not blocked in its rotary movement by seizing of the injection plunger. In accordance with the invention, the design can thus be constructed in a simple way such that the driver is guided in axial grooves on the circumference of the main injection plunger. In order to facilitate a relative rotation of the coupling, it is possible in accordance with the invention for the spring holding the preinjection plunger bearing against the main injection plunger to be supported on the driver via a thrust bearing.

The invention is explained diagrammatically, with reference to exemplary embodiments, in the drawing.

Figure 1:
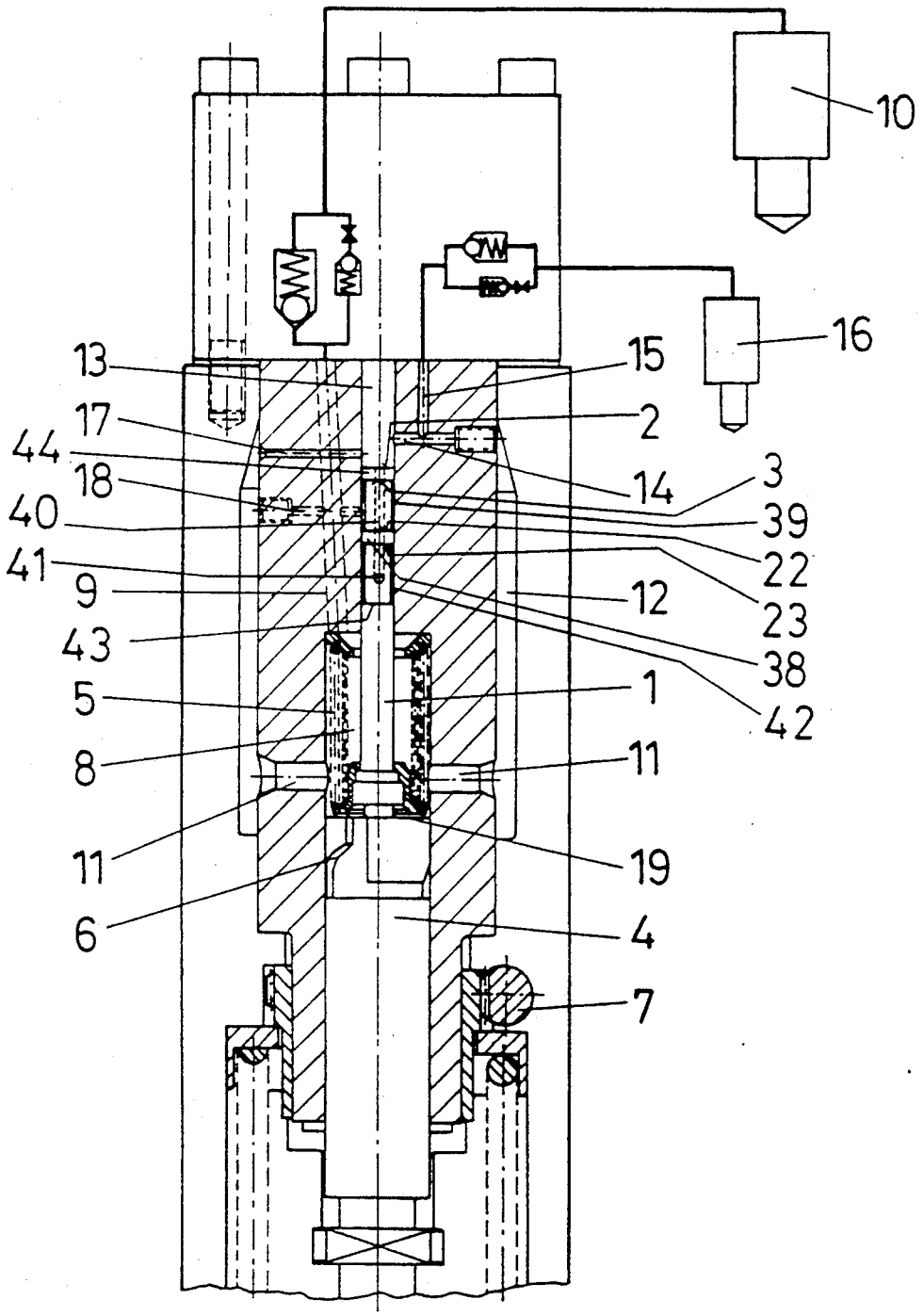
FIGS. 1 to 6 show a first exemplary embodiment, FIG. 1 showing the bottom dead-center position of the plunger and FIGS. 2 to 6 showing the plunger in different working phases or positions.

In the exemplary embodiment of FIGS. 1 to 6, the preinjection plunger 1 has straight control edges 2 and 3 delimiting a first collar 44, and therefore rests freely rotatably on the main injection plunger 4 under the action of springs 5. The preinjection plunger 1 is lifted against the force of the springs 5 by the main injection plunger 4, which is actuated by a cam (not represented), the springs 5 holding the preinjection plunger 1 bearing against the main injection plunger 4. The main injection plunger 4 has bevelled-edge controls 6 and can be rotated in the normal way by means of a control rod 7. The working chamber 8 of the main injection plunger 4 is connected via a delivery bore 9 to the main injection nozzle 10. This working chamber 8 is connected to the suction and overflow chamber 12 via two suction and overflow bores 11. The working chamber 13 of the preinjection plunger 1 is connected to a separate preinjection nozzle 16 via delivery bores 14 and 15.

Figure 2:
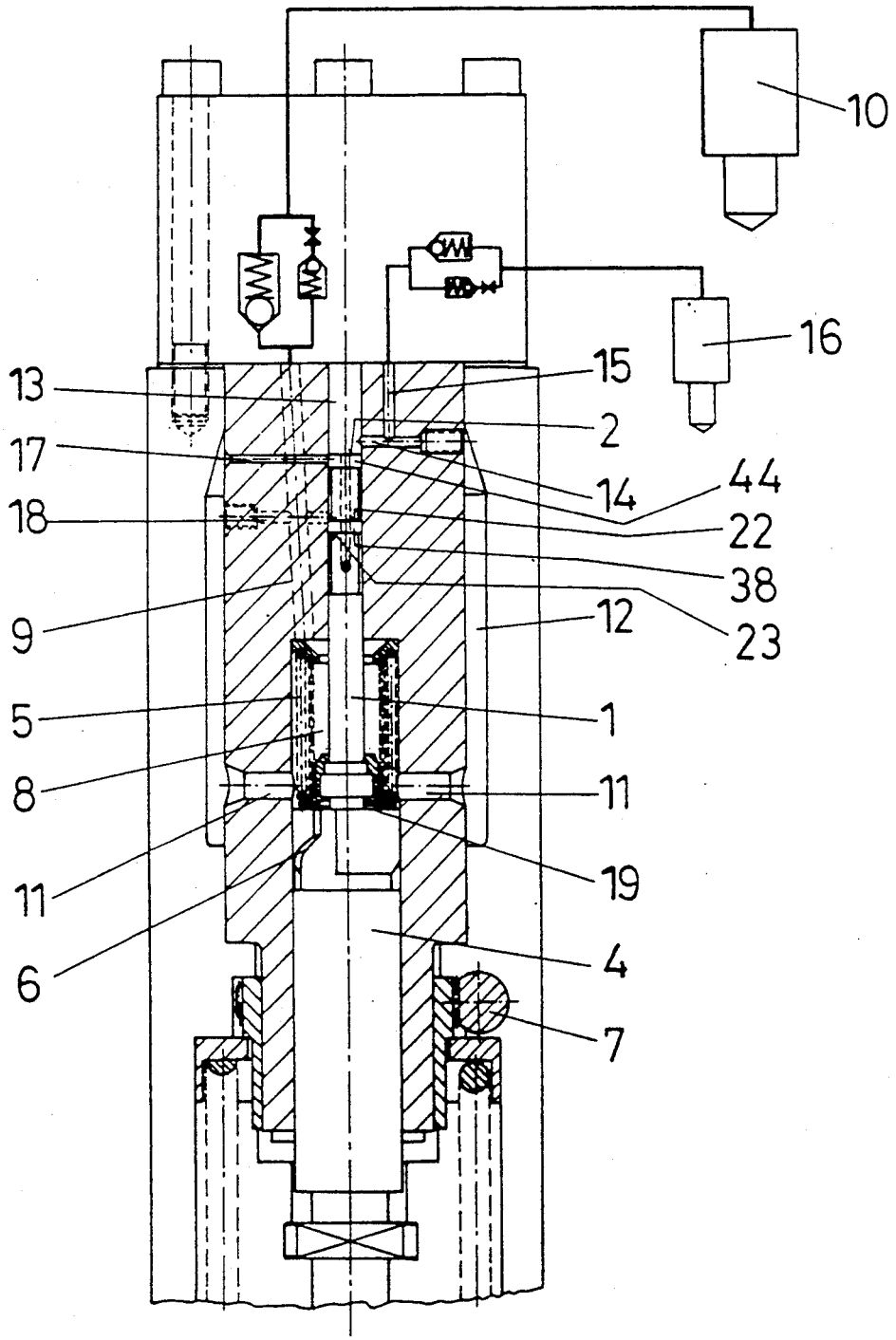
Figure 3:
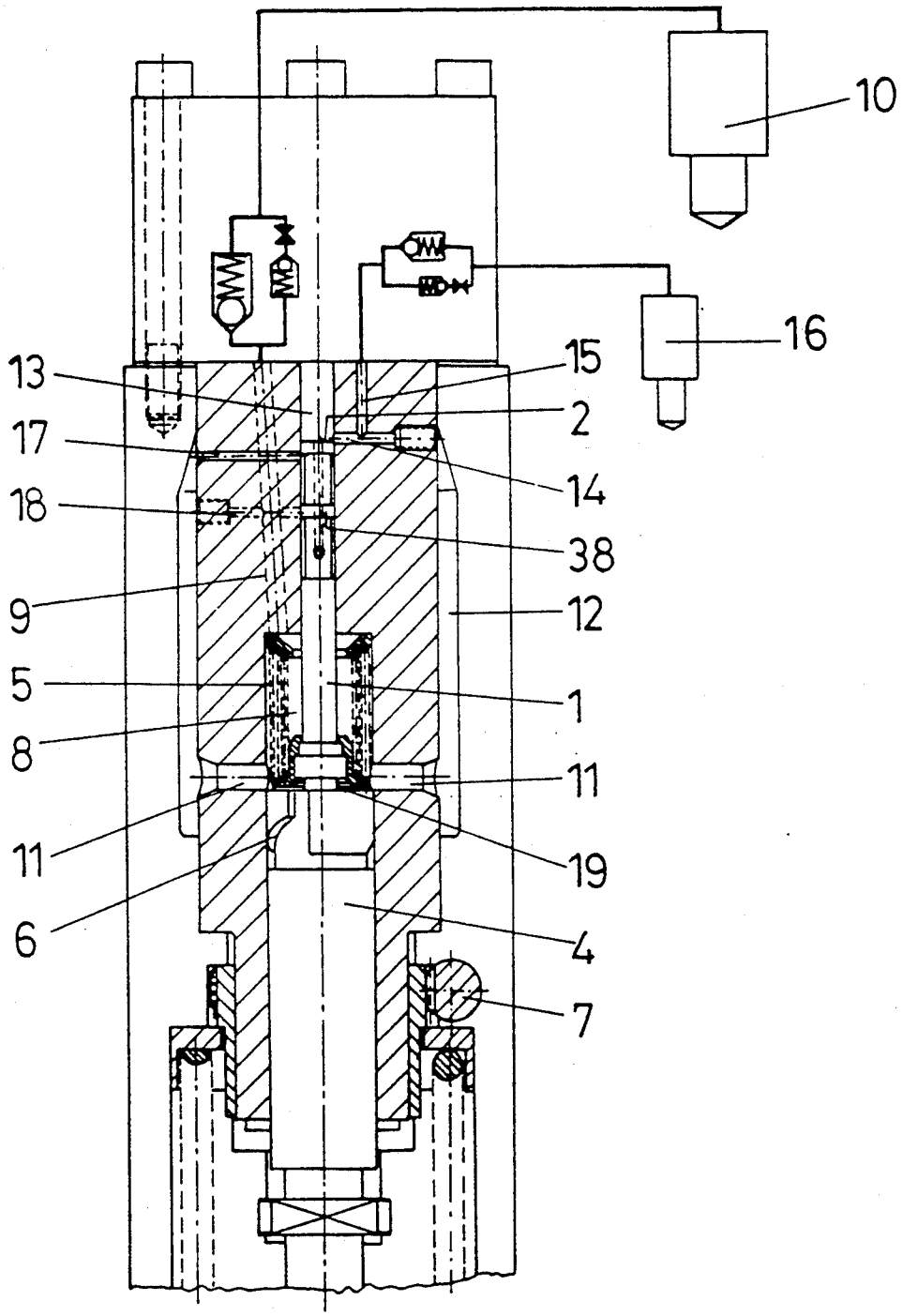

The start of delivery of the preinjection plunger 1 is represented in FIG. 2. Starting from the bottom dead-center position (FIG. 1), the control edge 2 seals an overflow bore 17 between the working chamber 13 and the suction and overflow chamber 12 (as represented in FIG. 2). This is the start of delivery of the preinjection plunger 1. This preinjection is (as FIG. 3 shows) terminated when the control edge 23 of the preinjection plunger 1 releases the connecting bore 18.

Figure 4:
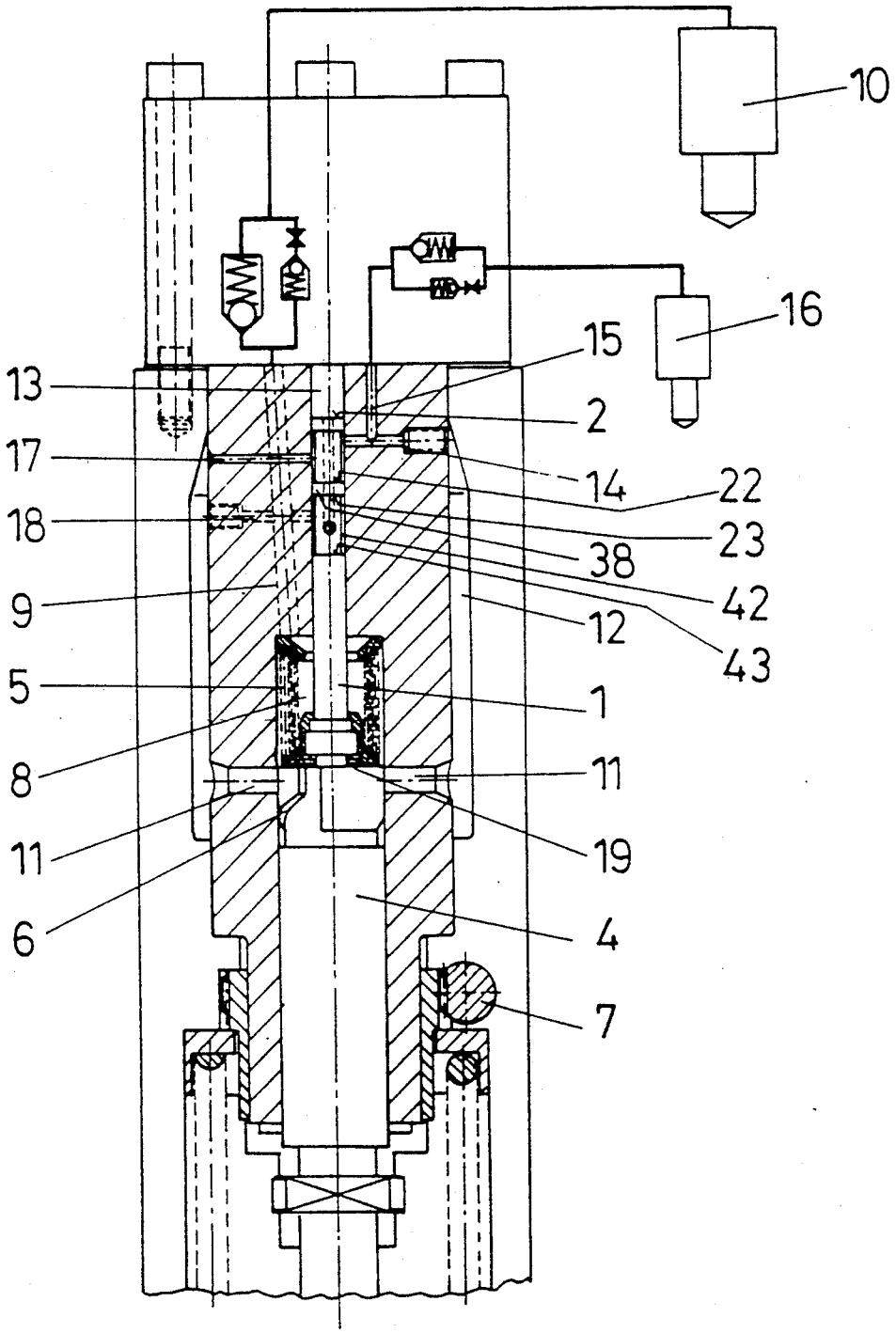
Figure 5:
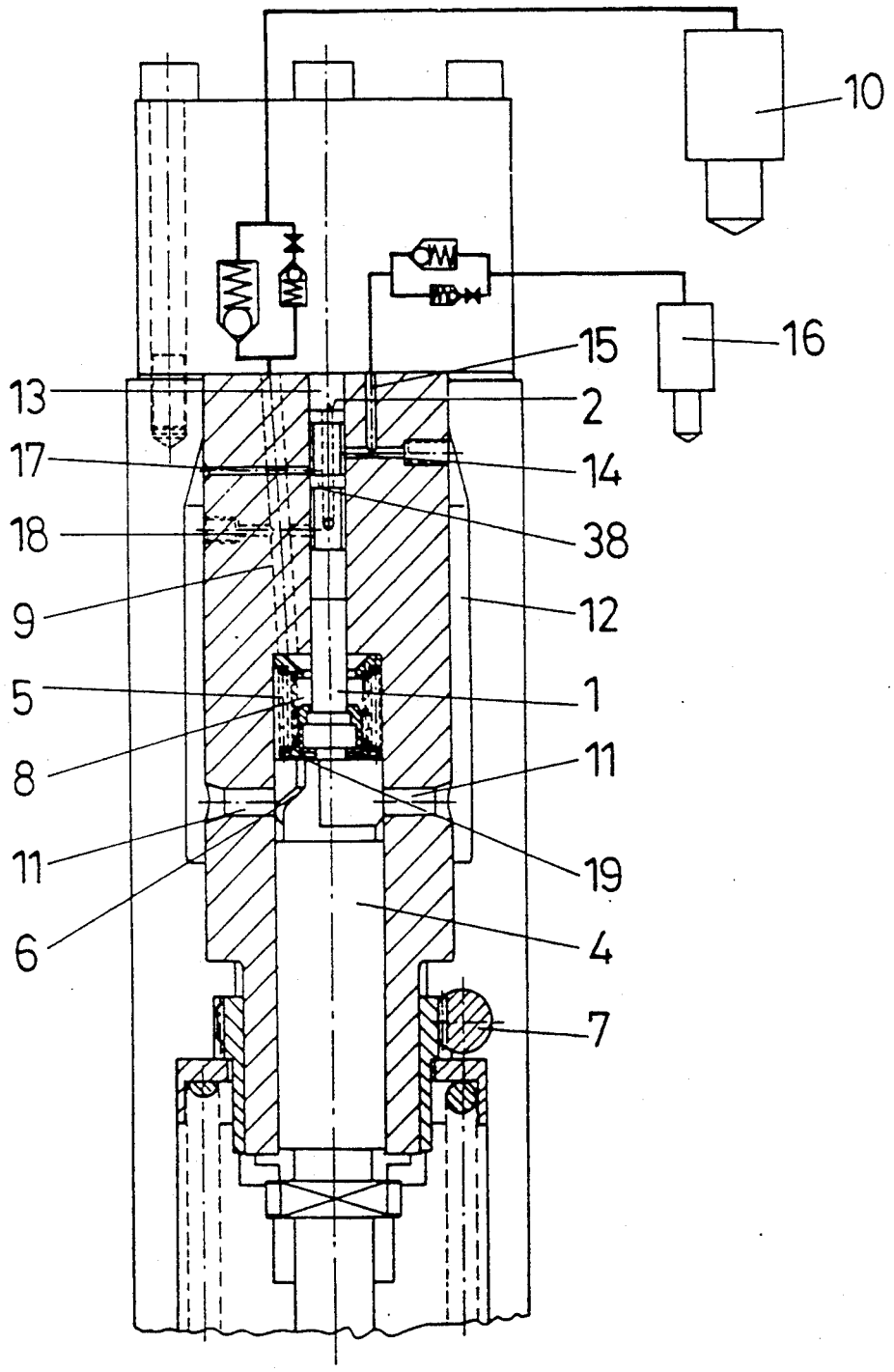

The start of delivery of the main injection plunger 4 is represented in FIG. 4. In this case, the upper edge 19 of the main injection plunger 4 seals the suction and overflow bores 11. At the end of delivery of the main injection plunger 4 (FIG. 5), the bevelled-edge control 6 of the main injection plunger 4 opens the suction and overflow bores 11.

In the plunger position according to FIG. 4, the control edge 3 has released the mouth of the delivery bore 14, and the delivery bore 14 is connected via the annular chamber 39 enclosed between the control edge 3 and a second collar 38, delimited by control edges 22 and 23, to the overflow bore 17, which discharges into the suction and overflow chamber 12. The preinjection is thus reliably terminated. At the same time, the working chamber 13 of the preinjection plunger 1 is connected via a central bore 40 and a transverse bore 41 to an annular chamber 42 which is delimited by the collar 38 and a shoulder 43. This annular chamber 42 is now connected to the delivery bore 9 via a connecting bore 18. This has the effect that the fuel displaced by the preinjection plunger 1 from the working chamber 13 passes into the delivery bore 9 leading to the main injection nozzle 10, and that this amount of fuel is also delivered to the main injection nozzle 10, so that the amount of fuel displaced by the preinjection plunger 1 in the second phase is added to the amount of fuel delivered by the main injection plunger 4. However, this also has the effect that the pressure built up in the working chamber 13 of the preinjection plunger 1 acts so as to press the preinjection plunger 1 on the main injection plunger 4, and that therefore the springs 5 must now be given weaker dimensions.

Figure 6:
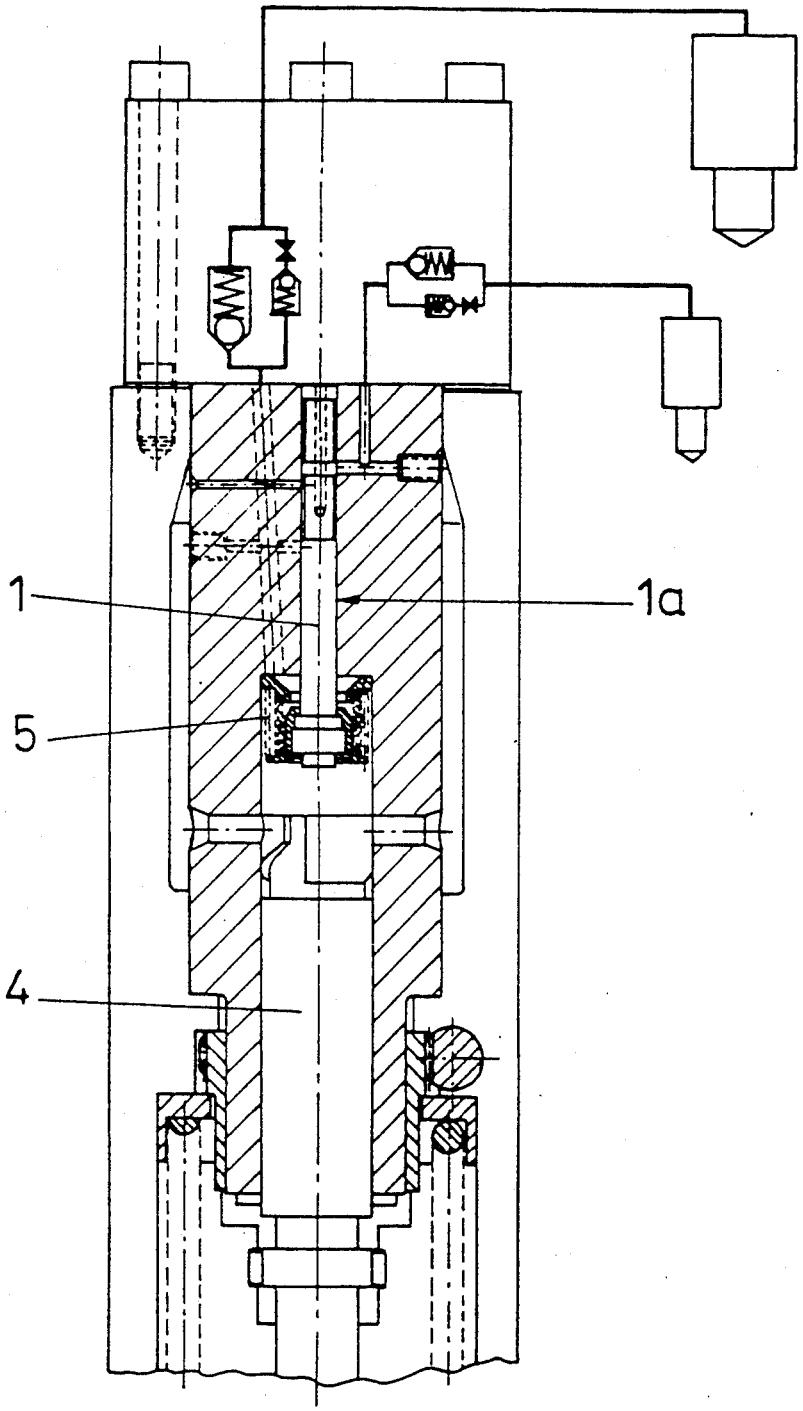

The position 1*a* of the preinjection plunger 1 in the event of jamming or seizing of the same is represented in FIG. 6. In this case, through the agency of the main injection plunger 4 the force of the cam pushes the preinjection plunger 1 right into the highest position 1*a*, in which it then comes to a standstill. In this process, the cam must overcome the jamming force acting on the preinjection plunger 1. In this position 1*a*, in which the springs 5 are completely compressed, the preinjection plunger 1 that has come to a standstill does not obstruct the stroke movement of the main injection plunger 4, and in this position the injection device and the engine can be operated further under emergency conditions, the preinjection being lost only up to the next overhaul.

Figure 7:
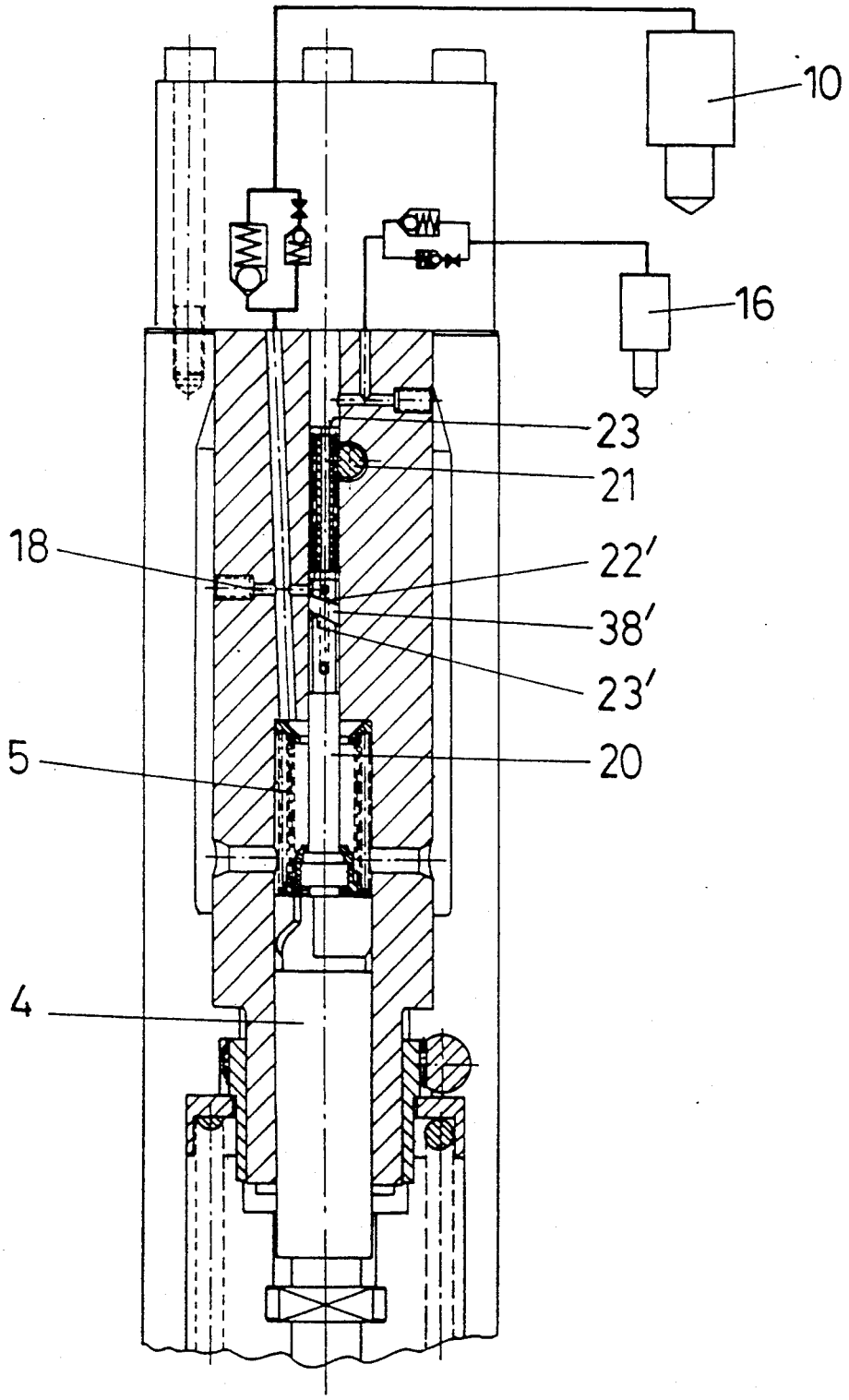
FIGS. 7 and 8 show a second exemplary embodiment, FIG. 7 representing the plunger in the bottom dead-center position and FIG. 8 the plunger in a seized position of the preinjection plunger.
Figure 8:
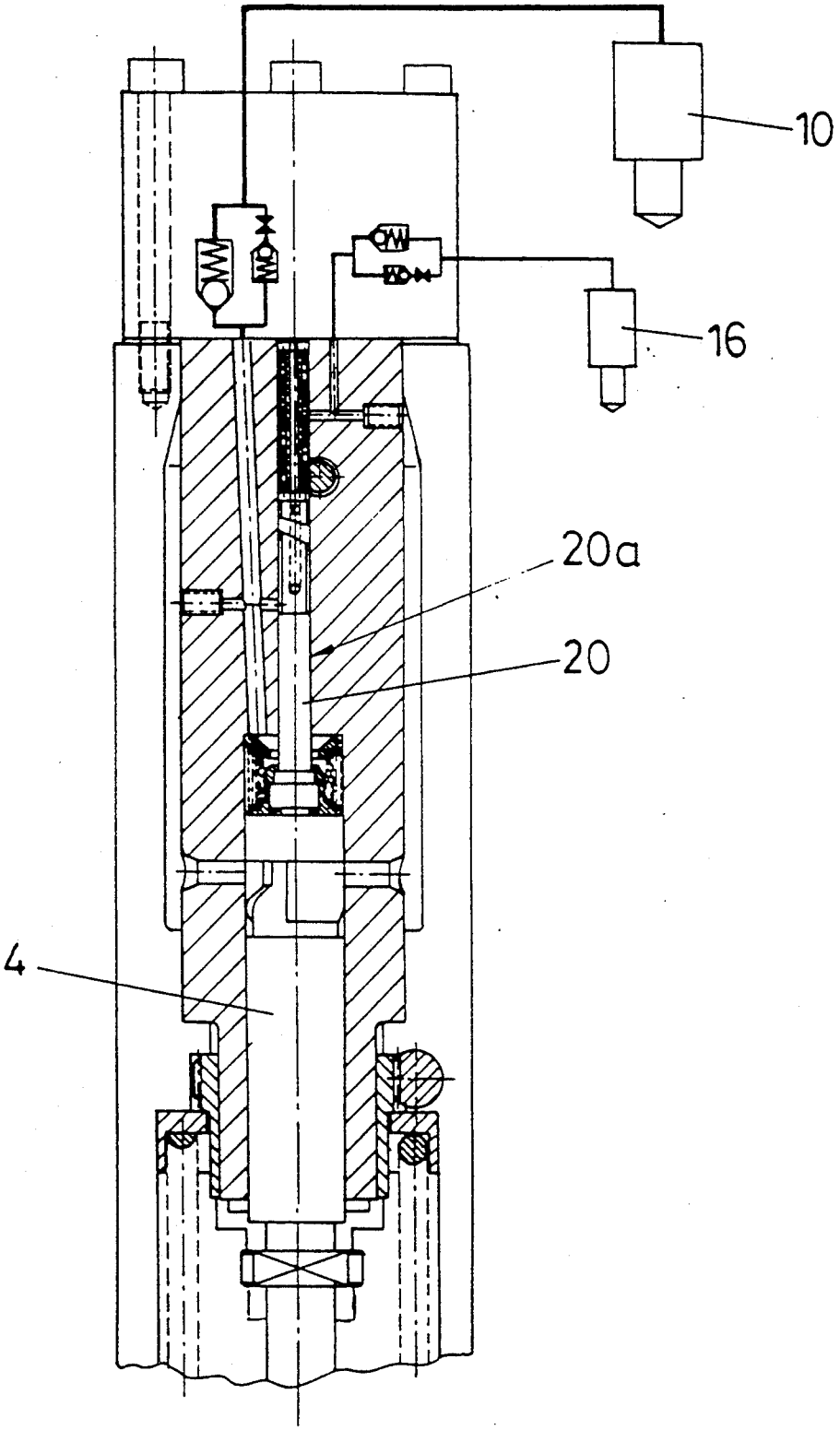

FIGS. 7 and 8 show another embodiment. The preinjection plunger 20 is supported freely rotatably on the main injection plunger 4, and is held bearing against the latter, once again by springs 5. The preinjection plunger 20 can be rotated via a control rod 21 independently of the main injection plunger 4, and now controls by means of bevelled-edge controls 22' and 23' on the collar 38' the start of delivery and the end of delivery, only one connecting bore 18, which acts as suction and overflow bore, being provided here. For the rest, the function is the same as represented and described in connection with FIGS. 2 to 5. Just as in FIG. 1, the plungers are represented in the bottom dead-center position in FIG. 7. Operation under emergency conditions is shown in FIG. 8, just as in FIG. 6. The preinjection plunger 20 has been pushed in the event of jamming by the cam and the main injection plunger 4 into the uppermost position 20*a*, and remains in this highest position during further operation as a consequence of the jamming or seizing, so that the function of the main injection plunger 4 is not disturbed.

Figure 9:
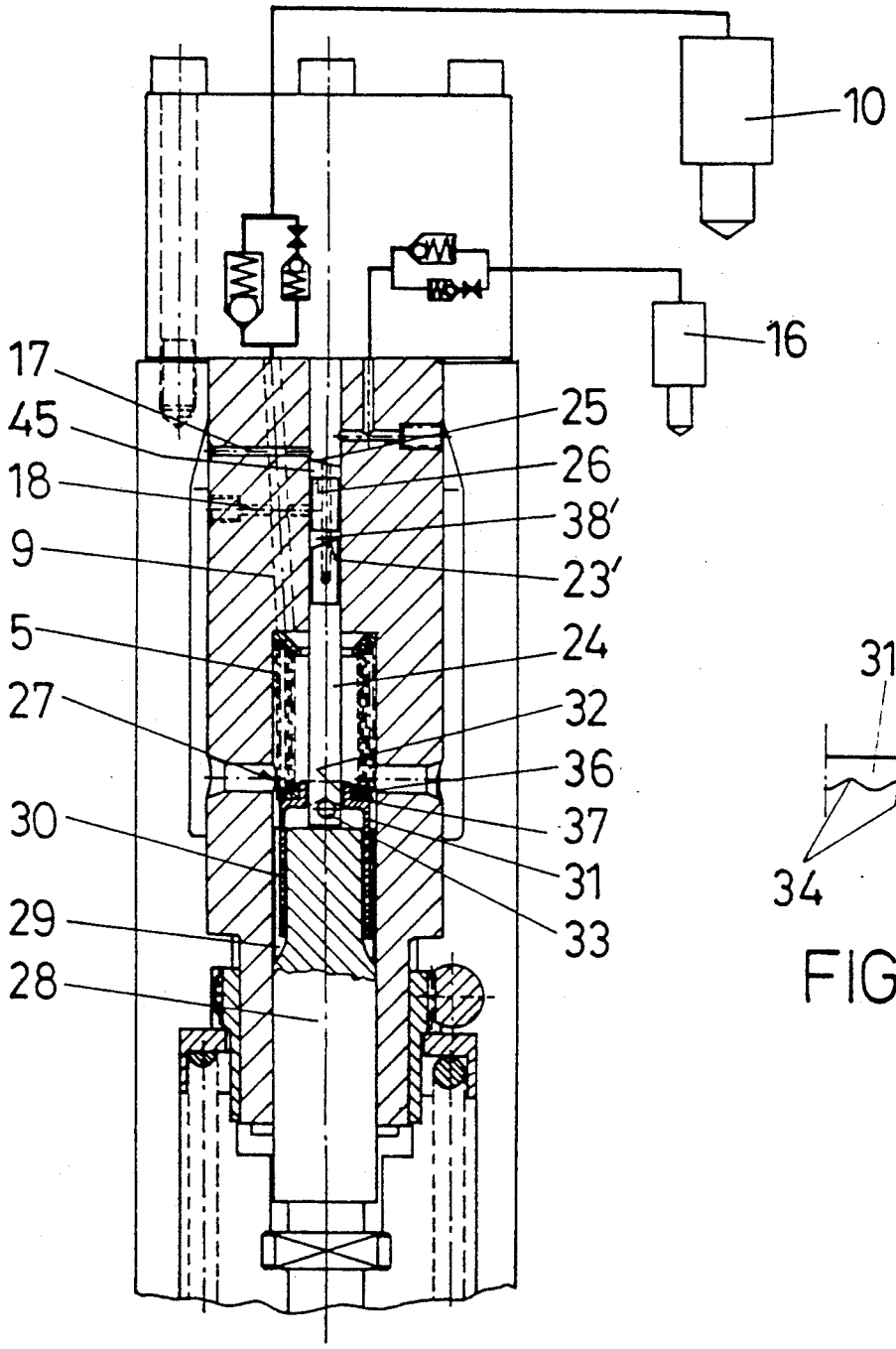
FIGS. 9, 10 and 11 show a third exemplary embodiment, FIG. 9 representing the plunger in the bottom dead-center position, FIG. 10 the preinjection plunger in a seized position, and FIG. 11 a detail.
Figure 11:
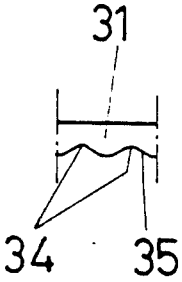
Figure 10:
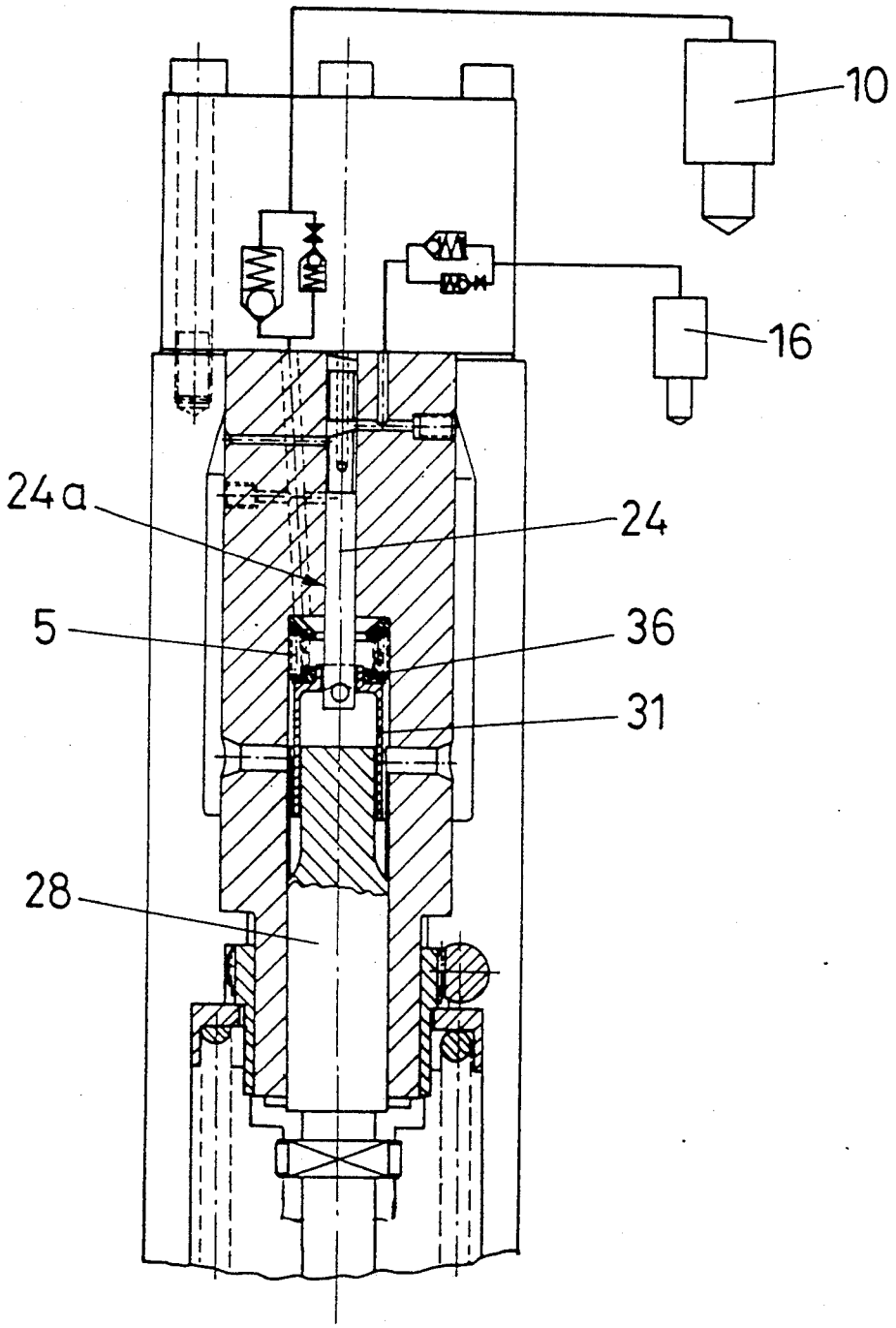

FIGS. 9, 10 and 11 show a further embodiment of the invention. The bottom dead-center position of the plunger is once again represented in FIG. 9. The preinjection plunger 24 once again has a first collar 45 delimited by control edges 25 and 26, the bevelled-edge control 25 on this first collar 45 and the bevelled-edge control 23' located below on the second collar 28, control the start of delivery and the end of delivery of the preinjection plunger 24 in cooperation with the suction and overflow bore 17 as a function of the rotary position of the preinjection plunger 24. Here, however, no separate control rod is provided for the rotation of the preinjection plunger 24, but the preinjection plunger 24 is coupled to the main injection plunger 28 via a torque-limiting rotary coupling 27 which permits relative axial displacement of the two plungers. For the purpose of this coupling, the main injection plunger 28 has on its circumference longitudinal grooves 29 in which tongues 30 of a driver 31 are guided, so that the driver 31 can be displaced axially relative to the main injection plunger 28. The springs 5 are now supported against this driver 31. The preinjection plunger 24 penetrates a central opening 32 of the driver 31, and has a crosspin 33 which engages in notches 34 of the driver 31. A development of these notches 34 is represented in FIG. 11. The crosspin 33 is held in these notches 34 by the springs 5. Since these notches 34 have bevelled flanks 35, the crosspin 33 can disengage from these notches when the predetermined torque is exceeded. This takes place in the event of jamming or seizing of the preinjection plunger 24.

FIG. 10 once again represents the position, denoted by 24*a*, of the preinjection plunger 24 in the highest jammed or seized position. In the axial direction, the preinjection plunger 24 in the seized position 24*a* does not impair the movement of the main injection plunger 28. However, the driver 31 is rotatably coupled to the main injection plunger 28, so that even in the seized position (FIG. 10) relative rotation still takes place between the lower spring plate 36 of the spring 5 and the driver 31. In order to take account of this, a thrust bearing 37 is interposed between this lower spring plate 36 and the driver 31.

List of reference symbols,

Preinjection plunger
1*a* Seized position of the preinjection plunger 1
2 Straight control edge
3 Straight control edge
4 Main injection plunger
5 Springs
6 Bevelled-edge control
7 Control rod for main injection plunger
8 Working chamber of the main injection plunger
9 Delivery bore to the main injection nozzle
10 Main injection nozzle
11 Suction and overflow bores for main injection plunger
12 Suction and overflow chamber .
13 Working chamber of the preinjection plunger
14, 15 Delivery bores to the preinjection nozzle
16 Preinjection nozzle
17 Overflow bore
18 Connecting bore to the delivery bore 9
19 End edge of the main injection plunger
20 Preinjection plunger
20*a* Seized position of the preinjection plunger 20
21 Control rod for preinjection plunger
22 (22') Control edge for preinjection—start
23 (23') Control edge for preinjection—end
24 Preinjection plunger (FIGS. 9 to 11)
24*a* Seized position of the preinjection plunger 24
25 Control edge for preinjection—start
26 Control edge for preinjection—end
27 Maximum rotary coupling
28 Main injection plunger (FIG. 9)
29 Guide grooves
30 Guide tongues of the driver
31 Driver
32 Central opening of the driver
33 Crosspin
34 Notches on the driver
35 Delimiting surfaces of the notches
36 Spring plate
37 Thrust bearing
38 Collar of the preinjection plunger
39 Annular chamber
40 Central bore in the preinjection plunger
41 Transverse bore in the preinjection plunger
42 Annular chamber
43 Shoulder
44 First collar
45 First collar

We claim:

1. A fuel injection device for internal combustion engines, comprising at least one main injection plunger (4; 28) delimiting a first working chamber and at least one preinjection plunger (1; 20; 24) delimiting a second working chamber, said main injection plunger is axially aligned with said preinjection plunger (1; 20; 24), and said preinjection plunger is driven by said main injection plunger to make axial stroke movements, said preinjection plunger has a smaller diameter than said main injection plunger, said main injection plunger (4; 28) being rotatable and fitted with an inclined-edge (6), and the preinjection plunger (1; 20; 24) being held in contact with the main injection plunger (4; 28) by the force of at least one spring (5), a first injection nozzle (10) being provided for a main injection of fuel out of said first working chamber and at least one second injection nozzle (16) being provided for a preinjection of fuel out of said second working chamber, resulting from a joint axial movement of said main injection plunger and said preinjection plunger, and said second working chamber being connected to said first working chamber after the preinjection plunger having completed its stroke executing said preinjection of fuel.

2. A fuel injection device according to claim 1, in which the connection of said second working chamber (13) of the preinjection plunger (1; 20; 24) to said first working chamber (8) of the main injection plunger (4; 28) is controlled by movement of the preinjection plunger (1; 20; 24).

3. A fuel injection device according to claim 2, in which the preinjection plunger (1; 20; 24) has a central bore (40), which is open towards said second working chamber (13) of the preinjection plunger and discharges via a transverse bore (41) into an annular chamber (42), which is delimited by a control edge (23) and a shoulder (43) and which can be connected via a connecting bore (18) to a delivery bore (9) leading to the main injection nozzle (10).

4. A fuel injection device according to claim 2, in which the preinjection plunger (1) has an annular chamber (39) delimited by two collars (38, 44, 38', 45), which has control edges (2, 3, 22, 23, 23') and connects the preinjection nozzle (16) to a suction chamber (12) of the injection device during the main injection via an overflow bore (17).

5. A fuel injection device according to claim 2, in which the preinjection plunger has two annular chambers (39, 42), which are delimited by two collars (38, 44, 38', 45) and a shoulder (43), and of which one annular chamber (39) serves to unload a pressure line to the preinjection nozzle and the other of said annular chambers (420 provides a connection between the second working chamber (13) of the preinjection plunger (1) and the main injection nozzle (10).

6. A fuel injection device according to claim 2, in which the preinjection plunger (1) is equipped with straight control edges (2, 3) for controlling the start and the end of the preinjection, and is freely rotatable with respect to the main injection plunger (4).

7. A fuel injection device according to claim 2, in which the preinjection plunger (24) is equipped with control edges (25, 26) for controlling the start and the end of the preinjection, of which at least one control edge extends obliquely, and in that the preinjection plunger (24) is coupled for rotation by means of a torque-limiting coupling (27) to the main injection plunger (28).

8. A fuel injection device according to claim 1, in which the preinjection plunger (1; 20; 24) has a central bore (40), which is open towards said second working chamber (13) of the preinjection plunger and discharges via a transverse bore (41) into an annular chamber (42), which is delimited by a control edge (23) and a shoulder (43) and which can be connected via a connecting bore (18) to a delivery bore (9) leading to the main injection nozzle (10).

9. A fuel injection device according to claim 8, in which the preinjection plunger (1) has an annular chamber (39) delimited by two collars (38, 44, 38', 45), which has control edges (2, 3, 22, 23, 23'), and connects the preinjection nozzle (16) to a suction chamber (12) of the injection device during the main injection via an overflow bore (17).

10. A fuel injection device according to claim 8, in which the preinjection plunger has two annular chambers (39, 42), which are delimited by two collars (38, 44, 38', 45) and a shoulder (43), and of which one annular chamber (39) serves to unload a pressure line to the preinjection nozzle and the other of said annular chambers (42) provides a connection between the second working chamber (13) of the preinjection plunger (1) and the main injection nozzle (10).

11. A fuel injection device according to claim 8, in which the preinjection plunger (1) is equipped with straight control edges (2, 3) for controlling the start and the end of the preinjection, and is freely rotatable with respect to the main injection plunger (4).

12. A fuel injection device according to claim 8, in which the preinjection plunger (24) is equipped with control edges (25, 26) for controlling the start and the end of the preinjection, of which at least one control edge extends obliquely, and in that the preinjection plunger (24) is coupled for rotation by means of a torque-limiting coupling (27) to the main injection plunger (28).

13. A fuel injection device according to claim 1, in which the preinjection plunger (1) has an annular chamber (39) delimited by two collars (38, 44, 38', 45), which has control edges (2, 3, 22, 23, 23') and connects the preinjection nozzle (16) to a suction chamber (12) of the injection device during the main injection via an overflow bore (17).

14. A fuel injection device according to claim 13, in which the preinjection plunger (1) is equipped with straight control edges (2, 3) for controlling the start and the end of the preinjection, and is freely rotatable with respect to the main injection plunger (4).

15. A fuel injection device according to claim 13, in which the preinjection plunger (24) is equipped with control edges (25, 24) for controlling the start and the end of the preinjection, of which at least one control edge extends obliquely, and in that the preinjection plunger (24) is coupled for rotation by means of a torque-limiting coupling (27) to the main injection plunger (28).

16. A fuel injection device according to claim 1, in which the preinjection plunger has two annular chambers (39, 42), which are delimited by two collars (38, 44, 38', 45) and a shoulder (43), and of which one annular chamber (39) serves to unload a pressure line to the preinjection nozzle and the other of said annular chambers (42) provides a connection between the second working chamber (13) of the preinjection plunger (1) and the main injection nozzle (10).

17. A fuel injection device according to claim 16, in which the preinjection plunger (1) is equipped with straight control edges (2, 3) for controlling the start and the end of the preinjection, and is freely rotatable with respect to the main injection plunger (4).

18. A fuel injection device according to claim 1, in which the preinjection plunger (1) is equipped with straight control edges (2, 3) for controlling the start and the end of the preinjection, and is freely rotatable with respect to the main injection plunger (4).

19. A fuel injection device according to claim 1, in which the preinjection plunger (20) is equipped with control edges (22', 23') for controlling the start and the end of the preinjection, of which at least one extends obliquely, and in that the preinjection plunger (20) can be rotated by means of a separate control rod (2).

20. A fuel injection device according to claim 1, in which the preinjection plunger (24) is equipped with control edges (25, 26) for controlling the start and the end of the preinjection, of which at least one control edge extends obliquely, and in that the preinjection plunger (24) is coupled for rotation by means of a torque-limiting coupling (27) to the main injection plunger (28).

21. A fuel injection device according to claim 20, in which a driver (31) is guided axially displaceably and non-rotatably on the main injection plunger (28) against which is supported the at least one spring (5) that fores the preinjection plunger (24) to bear against the main injection plunger (28), and the preinjection plunger penetrates the driver (31) and has a cross-pin (33) which engages in recesses (34) of the driver (31) under the force of the at least one spring (5) holding the preinjection plunger (24) to bear against the main injection plunger.

22. A fuel injection device according to claim 21, in which the at least one spring (5) holding the preinjection plunger (24) to bear against the main injection plunger (28) is supported on the driver (31) via a thrust bearing (37).

23. A fuel injection device according to claim 21, in which the driver (31) is guided in axial grooves (29) on the circumference of the main injection plunger (28).

24. A fuel injection device according to claim 23, in which the at least one spring (5) holding the preinjection plunger (24) to bear against the main injection plunger (28) is supported on the driver (31) via a thrust bearing (37).

* * * * *